US005888691A

United States Patent [19]

Laing et al.

[11] Patent Number: 5,888,691

[45] Date of Patent: Mar. 30, 1999

[54] PROCESS FOR PRODUCING TONER

[75] Inventors: John R. Laing, Rochester; Mit G. Turakhia, Fairport; Hui Chang, Pittsford, all of N.Y.

[73] Assignee: Xerox Corporation, Stamford, Conn.

[21] Appl. No.: 977,278

[22] Filed: Nov. 24, 1997

[51] Int. Cl.[6] ..... G03G 9/08

[52] U.S. Cl. ..... 430/137

[58] Field of Search ..... 430/137

[56] References Cited

U.S. PATENT DOCUMENTS

| | | | |
|---|---|---|---|
| 4,054,381 | 10/1977 | Bernhard | 399/359 |
| 4,494,863 | 1/1985 | Laing | 399/354 |
| 4,524,120 | 6/1985 | Budny et al. | 430/137 |
| 4,621,039 | 11/1986 | Ciccarelli et al. | 430/137 |
| 4,784,333 | 11/1988 | Hikakae et al. | 430/137 |
| 5,200,788 | 4/1993 | Thayer | 399/449 |
| 5,238,769 | 8/1993 | Bigelow et al. | 430/125 |
| 5,563,613 | 10/1996 | Chang et al. | 430/137 |
| 5,569,572 | 10/1996 | Laing et al. | 430/137 |

*Primary Examiner*—Roland Martin
*Attorney, Agent, or Firm*—John L. Haack

[57] ABSTRACT

A process involving: collecting waste toner; screening the collected waste toner; melt mixing the screened waste toner with a second toner, and grinding and classifying the melt mixed toner product.

20 Claims, No Drawings

PROCESS FOR PRODUCING TONER

REFERENCE TO COPENDING AND ISSUED PATENTS

Attention is directed to commonly owned and assigned U.S. Pat. Nos. 4,054,381, 4,494,863, and 5,200,788.

The disclosures of each the above mentioned patents are incorporated herein by reference in their entirety. The appropriate components of these patents may be selected for the processes of the present invention in embodiments thereof.

BACKGROUND OF THE INVENTION

The present invention is generally directed to processes for the reclamation, remanufacture, and reuse of waste or spent toner compositions. More specifically, the present invention relates to processes for the reclamation and remanufacture of used toner compositions comprising reformulating waste toner particles with new, unused or pristine toner compositions, and reuse of the resulting toner particles with, for example, carrier particles in two component xerographic developers.

Recycling or reclamation processes of xerographic developers and toner compositions, such as toner fines are known in the art. The prior art processes are generally directed to reclaiming and reusing waste toner particles within the confines of a printing machine, or alternatively, reclaiming and reusing waste toner particles arising from a toner manufacturing process within the confines of a toner manufacturing facility.

The present invention, in contrast, provides, in embodiments, processes for recycling or reclamation of waste toners comprising reclaiming waste toner particles, for example, from one or more printing machines in field use; co-locating the reclaimed waste toner, for example, in a recycling, reprocessing, or remanufacturing facility; screening the waste toner to remove debris; melt mixing the screened waste toner in admixture with pristine or fresh toner constituents or ingredients; and processing the resulting melt mixed product in a conventional fashion, for example, grinding and classifying, to provide remanufactured toner particles which contain reclaimed or waste toner, for example, in amounts of from about 1 to about 25 weight percent, and which remanufactured toner when installed in a printing or copying machine has xerographic performance properties which are substantially the same as those obtained from toner prepared entirely from fresh toner constituents.

PRIOR ART

U.S. Pat. No. 4,054,381, issued Oct. 18, 1977, to Berhard, discloses a toner filter arrangement adapted for use in a cleaning station of a xerographic reproduction machine whereby foreign matter and other contaminates are removed from residual toner prior to its collection in a disposable or re-use container or return to the developer station. The filter arrangement comprises a housing having an input opening through which removed toner enters and an output opening through which filtered toner exits by gravity feed.

U.S. Pat. No. 5,200,788, issued Apr. 6, 1993, to Thayer, discloses a brush auger reclaim filtration assembly incorporated into an open ended chamber contained in a printing machine. The brush auger is a toner reclaim filtration device that is rotatably mounted in the chamber to move toner and debris along a separating screen. Also contained in the housing is a mounted transport auger that rotates as it moves the reclaimed toner to the developer housing.

U.S. Pat. No. 4,494,863, issued Jan. 22, 1985, to Laing, discloses a toner removal device for removing residual toner and debris from a charge retentive surface after transfer of toner images from the surface. This device is characterized by the use of a pair of detoning rolls, one for removing toner from a biased cleaner brush and the other for removing debris such as paper fibers and kaolin from the brush. The rolls are electrically biased so that one of them attracts toner from the brush while the other one attracts debris. Thus, the toner can be reused without degradation of copy quality while the debris can be discarded.

These patents relate to an apparatus for reclaiming and re-use of waste toner particles within a printing machine and are not believed to embody removal of the reclaimed toner from the machine for remanufacture with fresh toner as in the present invention.

Other patents of interest include U.S. Pat. Nos. 5,272,034; 5,147,753; and 5,111,998, which patents relate to conventional toner manufacturing processes wherein there is generated a waste stream of toner particles, for example, coarse or fines, and which waste toner particles are returned or recycled into an earlier step or stage in the toner manufacturing process. These patents are not believed to contemplate removal of reclaimed waste toner from a printing machine for remanufacture with fresh toner as in the present invention.

The aforementioned references are incorporated in their entirety by reference herein.

Conventional xerographic development processes are relatively inefficient in the utilization of toner particles in various developers, for example, up to about 20 weight percent of the toner deposited on a photoreceptor in developing latent images is typically routinely recovered, such as by cleaning, as waste toner in a toner sump.

In an extensive study of fresh or newly manufactured toner particles and waste toner particles, the principal difference observed was that the waste toner contained, for example, paper fibers and other extraneous debris. Paper fibers and the like particulates can tend to charge to an opposite polarity from the toner particles and which lead to copy quality defects in, for example, background areas. The aforementioned commonly owned and assigned U.S. Pat. No. 4,494,863, accomplishes "in-machine" electrostatic separation of particles of opposite polarity prior to return of the cleaned toner to the developer housing.

In view of the increasing costs and regulation associated with land fill and related waste disposal facilities, it is desired to recycle and to re-use waste toner particles in batch or continuous processes readily and conveniently at, for example, a central processing facility. Earlier attempts to recycle reclaimed toner particles by, for example, collecting waste toner, screening the collected waste toner to remove extraneous debris and agglomerates, conditioning the screened waste toner with surface additives, repackaging, and reusing the conditioned toner in a marking process, proved to be difficult and typically ineffective in reproducibly providing toner particles with the requisite triboelectric, conductivity, and flow properties necessary for high copy quality and high volume printing machine performance.

The present invention, in embodiments, provides toner particle recycling processes which reduce or eliminate land fill waste streams arising from toner manufacturing processes and toner reclamation schemes.

There has been a long sought need for an economical, efficient and environmentally efficacious means for producing remanufactured toner particle products from waste toner materials that would otherwise be destined for landfill disposal.

SUMMARY OF THE INVENTION

Embodiments of the present invention, include:

overcoming, or minimizing deficiencies of the prior art by providing processes with improved efficiency, improved flexibility, and improved operational economies;

providing a waste toner particle reclamation and remanufacture process comprising:

collecting waste toner from at least one printing machine;

screening the collected waste toner to remove extraneous debris to yield screened waste toner;

melt mixing the screened waste toner in admixture with fresh toner comprising a resin, and a colorant, to provide a homogenous melt mixture product; and grinding and classifying the melt mixture product to provide remanufactured toner particles;

providing waste toner particle reclamation and remanufacture processes further comprising: conditioning the remanufactured toner melt mixture product comprised of reclaimed toner particles and new toner ingredients with various performance additives, either during melt mixing or subsequent to melt mixing, whereby the triboelectric, conductivity, flow, and other important physical and performance properties of the toner are substantially identical to those properties corresponding to toner particles prepared entirely from fresh toner ingredients, that is, in the absence of any reclaimed toner material.

DETAILED DESCRIPTION OF THE INVENTION

The preparative processes of the present invention may be used to process and prepare a variety of toner particulate materials, including reclaimed toner particles for use in remanufactured liquid and dry developer marking applications in a cost efficient manner. A particularly salient advantage of the present invention is that the processes thereof afford control over the toner particle performance and physical properties and thereby overcome many of the problems and disadvantages of prior art recycling and reclamation processes.

In embodiments, the present invention provides a toner remanufacture and reuse process comprising: collecting waste toner; screening the collected waste toner; melt mixing the screened waste toner with a second toner material comprising, for example, fresh toner constituents comprising resin, colorant, charge additives, surface additives, and the like, in a proper ratio to form a toner, and grinding and classifying the melt mixed toner product.

In other embodiments, there is provided a toner remanufacture and reuse process comprising:

collecting waste toner from at least one printing machine;

screening the collected waste toner to remove extraneous debris to afford screened waste toner;

melt mixing, for example, in an extruder or a Banbury/two roll mill apparatus, the screened waste toner in admixture with fresh toner constituents comprising a resin, and a colorant, to provide melt mixed product; and grinding and classifying the melt mixed product to provide remanufactured toner particles.

In embodiments, the remanufactured toner can be, if desired, further treated with various surface additives to ensure the toner has and maintains certain physical and performance properties, and which properties are required for high performance in a dry or liquid marking application and as illustrated herein. In embodiments, one or more surface additives, for example, for 1 to about 10 surface additives, may be applied to the remanufactured toner particles. Examples of surface additives include, flow additives such as fumed silicas and the like particles, charge additives, such as quaternary ammonium salts, and release agents or waxes, such as UNILIN® waxes, and mixtures thereof, and as illustrated herein.

In embodiments, the reclaimed and screened toner particles can be remanufactured with fresh toner ingredients, for example, by melt mixing or extruding the fresh toner ingredients mixed with the reclaimed and screened toner particles followed by grinding, classifying, and screening.

The fresh or second toner comprises toner constituents including, for example, a resin or resins, a colorant or colorants, a charge additive, a flow additive, and physical and melt mixtures thereof. In other embodiments, the second toner can further comprise recovered or recycled toner fines.

The reclaim and remanufacture processes of the present invention enable highly reliable and economic procedures wherein reclaimed waste toner can be returned to a useful and active service life in amounts of from about 80 to about 99.9 percent based on the amount of waste toner initially reclaimed.

In embodiments, the admixture of waste toner to fresh toner in the toner remanufacture process can be in a weight ratio of from about 1 to about 40 percent, preferably of from about 2 to about 20 percent, and more preferably of from about 10 to about 20 percent. Also, the reclaimed toner particles can be obtained from one or more printing machines, for example, from 1 to about 1,000,000 xerographic, liquid developer, and the like marking machines. The waste toner can be collected from the waste toner sumps or similar waste receptacles within the marking machines. The reclaimed toner particles to be remanufactured with fresh toner ingredients are preferably obtained from the same or similar printing machines or models, that is, the extent and difficulty in reconditioning the remanufactured toner particles will be minimized if the reclaimed toner material has a composition which is the same or similar composition or origin as that of the fresh toner ingredients.

The screening of reclaimed toner particles can be accomplished with, for example, a screen with a mesh size diameter cut off of about 30 to about 50 microns, and preferably from about 40 to about 45 microns, and wherein the screened waste toner has a volume average particle size diameter, for example, preferably from about 8 microns to about 20, and more preferably about 8 to about 12 microns. The function of the screening of the reclaimed toner is primarily to remove extraneous debris, and which debris comprises, for example, paper fibers, paper particulates, ambient dust or soot, machine dirt, toner agglomerates and aggregates, carrier beads, carrier particulate spall or fragments, and other foreign debris, such as staples, paper clips, hair fibers, textile fibers, bottle caps, and the like, and mixtures thereof, and wherein the average particle size of said debris is greater than mesh size diameter cut off range of the screen of greater than about 40 microns, for example, from about 40 to about 45 microns.

The screening process and screening equipment used to screen the waste toner maintains proper material consistency, which is very close to the consistency for fresh toner, that is, for example, there is insignificant loss of the principal toner constituents, such as carbon black, magnetite, and resin components in the waste toner during the screening process.

In embodiments, the melt mixing of the admixture of reclaimed toner and fresh toner ingredients can be accomplished, for example, by physically mixing or blending the particles and then melt mixing, for example, in a ZSK-83 extruder with a melt temperature of about 300° to about 500° F., preferably from about 325° to about 475° F., and more preferably from about 350° to about 450° F., and wherein the toner extrudate has the desired composition of colorants and additives, such as the aforementioned charge additives, waxes, and the like, and the dispersion of the components of the remanufactured toner material, as measured by transmission electron microscopy and similar methods, is satisfactory. In illustrative embodiments, the remanufactured toner material, comprised of, for example, about 10 to about 20 weight percent of the reclaimed and screened toner particles, possesses a glass transition temperature of about 50° to about 60° C., and preferably about 55° C., and a melt index of about 20 to about 35 g/10 minutes, and preferably from about 23 to about 31 g/10 minutes, and a triboelectric charge of about 10 to about 25 microcoulombs per gram, and preferably about 11 to about 21 microcoulombs per gram.

The second toner comprises toner constituents including, for example, a resin or resins, a colorant or colorants, a charge additive, a flow additive, recovered or recycled toner fines, and physical and melt mixtures thereof. The particle size of the second toner or toner constituents can be from several microns to several hundred microns in diameter.

Toner compositions can be prepared by a number of known methods, such as admixing and heating resin particles obtained with the processes of the present invention, such as water soluble or insoluble styrene butadiene copolymers and related polymeric materials in amounts of about 60 to 98 weight percent of the composition, pigment particles such as magnetite, carbon black, or mixtures thereof, and colored pigments such as cyan, yellow, magenta, green, brown, red, or mixtures thereof in amounts of about 2 to about 25 weight percent of the composition, and from about 0.5 percent to about 5 percent of charge enhancing additives, in a toner extrusion device, such as the ZSK53 available from Werner Pfleiderer, and removing the formed toner composition from the device. Subsequent to cooling, the toner composition is subjected to grinding utilizing, for example, a Sturtevant micronizer for the purpose of achieving toner particles with a volume median diameter of less than about 25 microns, and preferably of from about 6 to about 12 microns, which diameters can be determined by a Coulter Counter. Subsequently, the toner compositions can be classified utilizing, for example, a Donaldson Model B classifier for the purpose of removing toner fines, that is toner particles less than about 4 microns volume median diameter. Alternatively, the toner compositions are ground with a fluid bed grinder, and then classified using a classifier equipped with a classifier wheel in accordance with the present invention.

Illustrative examples of resins suitable for toner and developer compositions of the present invention include branched and unbranched styrene acrylates, styrene methacrylates, styrene butadienes, vinyl resins, including branched and unbranched homopolymers and copolymers of two or more vinyl monomers; vinyl monomers including, for example, styrene compounds, p-chlorostyrene, dienes, such as butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Preferred toner resins include styrene butadiene copolymers, mixtures thereof, and the like. Other preferred toner resins include styrene/n-butyl acrylate copolymers, PLIOLITES®; suspension polymerized styrene butadienes, reference U.S. Pat. No. 4,558,108, the disclosure of which is totally incorporated herein by reference. Suitable toner resins also include uncrosslinked and crosslinked polyesters, for example, comprising at least one diacid or anhydride and at least one diol, such as disclosed in commonly owned and assigned U.S. Pat. No. 5,376,494, the disclosure of which is incorporated herein in its entirety.

In toner compositions, the resin particles are present in a sufficient but effective amount, for example from about 70 to about 90 weight percent. Thus, when 1 percent by weight of the charge enhancing additive is present, and 10 percent by weight of pigment or colorant, such as carbon black, is contained therein, about 89 percent by weight of resin is selected. Also, the charge enhancing additive may be coated on the pigment particle. When used as a coating, the charge enhancing additive is present in an amount of from about 0.1 weight percent to about 5 weight percent, and preferably from about 0.3 weight percent to about 1 weight percent.

Numerous well known suitable pigments or dyes can be selected as the colorant for the toner particles including, for example, carbon black like REGAL 330®, nigrosine dye, aniline blue, magnetite, or mixtures thereof. The pigment, which is preferably carbon black, should be present in a sufficient amount to render the toner composition highly colored. Generally, the pigment particles are present in amounts of from about 1 percent by weight to about 20 percent by weight, and preferably from about 2 to about 10 weight percent based on the total weight of the toner composition; however, lesser or greater amounts of pigment particles can be selected in attaining preferred toner properties.

When the pigment particles are comprised of magnetites, thereby enabling single component toners in some instances, which magnetites are a mixture of iron oxides ($FeO.Fe_2O_3$) including those commercially available as MAPICO BLACK®, they are present in the toner composition in an amount of from about 10 percent by weight to about 70 percent by weight, and preferably in an amount of from about 10 percent by weight to about 50 percent by weight. Mixtures of carbon black and magnetite with from about 1 to about 15 weight percent of carbon black, and preferably from about 2 to about 6 weight percent of carbon black, and magnetite, such as MAPICO BLACK®, in an amount of, for example, from about 5 to about 60, and preferably from about 10 to about 50 weight percent can be selected.

There can also be blended with the toner compositions of the present invention external additive particles including flow aid additives, which additives are usually present on the surface thereof. Examples of these additives include colloidal silicas, such as AEROSIL®, metal salts and metal salts of fatty acids inclusive of zinc stearate, aluminum oxides, cerium oxides, titanium oxides, tin oxides, and mixtures thereof, which additives are generally present in an amount of from about 0.1 percent by weight to about 10 percent by weight, and preferably in an amount of from about 0.1 percent by weight to about 5 percent by weight. Several of the aforementioned additives are illustrated in U.S. Pat. Nos. 3,590,000 and 3,800,588, the disclosures of which are totally incorporated herein by reference.

With further respect to the present invention, colloidal silicas, such as AEROSIL®, can be surface treated with the charge additives in an amount of from about 1 to about 30 weight percent and preferably 10 weight percent followed by the addition thereof to the toner in an amount of from 0.1 to 10 and preferably 0.1 to 1 weight percent.

Also, there can be included in the toner compositions low molecular weight waxes, such as polypropylenes and polyethylenes commercially available from Allied Chemical and Petrolite Corporation, EPOLENE N-15® commercially available from Eastman Chemical Products, Inc., VISCOL 550-P®, a low weight average molecular weight polypropylene available from Sanyo Kasei K.K., and similar materials. The commercially available polyethylenes selected have a molecular weight of from about 1,000 to about 1,500, while the commercially available polypropylenes utilized for the toner compositions are believed to have a molecular weight of from about 4,000 to about 5,000. Many of the polyethylene and polypropylene compositions useful in the present invention are illustrated in British Patent No. 1,442,835, the disclosure of which is totally incorporated herein by reference. Other waxes include known fatty acid compounds, fatty acid salts such as zinc stearate, and the like compounds, and mixtures thereof.

The low molecular weight wax materials are optionally present in the toner composition or the polymer resin beads of the present invention in various amounts, however, generally these waxes are present in the toner composition in an amount of from about 1 percent by weight to about 15 percent by weight, and preferably in an amount of from about 2 percent by weight to about 10 percent by weight and may in embodiments function as fuser roll release agents.

Encompassed within the scope of the present invention are colored toner and developer compositions comprised of toner resin particles, carrier particles, the charge enhancing additives illustrated herein, and as pigments or colorants red, blue, green, brown, magenta, cyan and/or yellow particles, as well as mixtures thereof. More specifically, with regard to the generation of color images utilizing a developer composition with charge enhancing additives, illustrative examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the Color Index as CI 69810, Special Blue X-2137, and the like; while illustrative examples of yellow pigments that may be selected are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy-4-sulfonanilide phenylazo-4'-chloro-2,5-dimethoxy acetoacetanilide, and Permanent Yellow FGL. The aforementioned pigments are incorporated into the toner composition in various suitable effective amounts providing the objectives of the present invention are achieved. In one embodiment, these colored pigment particles are present in the toner composition in an amount of from about 2 percent by weight to about 15 percent by weight calculated on the weight of the toner resin particles.

For the formulation of two component developer compositions, there are mixed with the toner particles carrier components, particularly those that are capable of triboelectrically assuming an opposite polarity to that of the toner composition. Accordingly, the carrier particles are selected to be of a negative polarity enabling the toner particles, which are positively charged, to adhere to and surround the carrier particles. Illustrative examples of carrier particles include iron powder, steel, nickel, iron, ferrites, including copper zinc ferrites, and the like. Additionally, there can be selected as carrier particles nickel berry carriers as illustrated in U.S. Pat. No. 3,847,604, the disclosure of which is totally incorporated herein by reference. The selected carrier particles can be used with or without a coating, the coating generally containing terpolymers of styrene, methylmethacrylate, and a silane, such as triethoxy silane, reference U.S. Pat. No. 3,526,533, U.S. Pat. No. 4,937,166, and U.S. Pat. No. 4,935,326, the disclosures of which are totally incorporated herein by reference, including for example KYNAR® and polymethylmethacrylate mixtures (40/60). Coating weights can vary as indicated herein; generally, however, from about 0.3 to about 2, and preferably from about 0.5 to about 1.5 weight percent coating weight is selected.

Furthermore, the diameter of the carrier particles, preferably spherical in shape, is generally from about 50 microns to about 1,000 microns, and in embodiments about 175 microns thereby permitting them to possess sufficient density and inertia to avoid adherence to the electrostatic images during the development process. The carrier component can be mixed with the toner composition in various suitable combinations, however, best results are obtained when about 1 to 5 parts per toner to about 10 parts to about 200 parts by weight of carrier are selected.

The toner composition of the present invention can be prepared by a number of known methods as indicated herein including extrusion melt mixing the toner resin particles, pigment particles or colorants, and a charge enhancing additive, followed by mechanical attrition. Other methods include those well known in the art such as spray drying, melt dispersion, emulsion aggregation, and extrusion processing. Also, as indicated herein the toner composition without the charge enhancing additive in the bulk toner can be prepared, followed by the addition of charge additive surface treated colloidal silicas.

The remanufactured toner compositions generated with the processes of the present invention may be selected for use in electrostatographic imaging apparatuses containing therein conventional photoreceptors providing that they are capable of being charged positively or negatively. Thus, the toner and developer compositions can be used with layered photoreceptors that are capable of being charged negatively, such as those described in U.S. Pat. No. 4,265,990, the disclosure of which is totally incorporated herein by reference. Illustrative examples of inorganic photoreceptors that may be selected for imaging and printing processes include selenium; selenium alloys, such as selenium arsenic, selenium tellurium and the like; halogen doped selenium substances; and halogen doped selenium alloys.

The remanufactured toner compositions are usually jetted and classified subsequent to preparation to enable toner particles with a preferred average diameter of from about 5 to about 25 microns, more preferably from about 6 to about 12 microns, and most preferably from about 8 to about 10 microns. Also, the toner compositions preferably possess a triboelectric charge of from about 0.1 to about 2 femtocoulombs per micron as determined by the known charge spectrograph. Admix time for toners are preferably from about 5 seconds to 1 minute, and more specifically from about 5 to about 15 seconds as determined by the known charge spectrograph. These toner compositions with rapid admix characteristics enable, for example, the development of images in electrophotographic imaging apparatuses, which images have substantially no background deposits thereon, even at high toner dispensing rates in some instances, exceeding 20 grams per minute; and further, such toner compositions can be selected for high speed electrophotographic apparatuses, that is those exceeding 70 copies per minute.

Also, the toner compositions prepared, in embodiments, of the present invention possess desirable narrow charge distributions, optimal charging triboelectric values, preferably of from 10 to about 40, and more preferably from about 10 to about 35 microcoulombs per gram as determined by the known Faraday Cage methods with from about 0.1 to about 5 weight percent in one embodiment of the charge enhancing additive; and rapid admix charging times as determined in the charge spectrograph of less than 15 seconds, and more preferably in some embodiments from about 1 to about 14 seconds.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Waste Toner Reclaim

In an illustrative procedure, the waste toner, about 10,000 pounds, compounds, contained in the waste sump from several thousand xerographic printing machines, such as the Xerox Corporation Model 5090, was collected and screened. The screening process involved a turbo screener equipped with a 42 micron screen, a high efficiency cyclone for toner and air separation, a toner particle eductor system for crude metering of toner, and a dust collection system to remove excess air and fine particulates of the waste toner. Reclaimed toner laden with paper fibers, carrier particles, and other debris was pushed through the air eductor system to the turbo screener where paper debris and other debris were removed with the screen. The screened toner was passed through an efficient cyclone separator to extract toner particles from the air stream.

Remanufactured Toner—Melt Mixing of Reclaimed Toner with Fresh Toner Constituents The screened toner was collected under the cyclone and was then mixed with a fresh toner constituents of resin and colorant, and then processed in an extruder, for example, a commercially available extruder from Werner and Pfleiderer. The extrudate was further processed through an Alpine grinder, a classifier, and a screener. The resulting remanufactured toner was reinstalled in a Xerox Corporation Model 5090™ and the toner properties and print quality were analyzed by conventional methods. The results observed for the remanufactured toner obtained by melt mixing reclaimed toner with fresh toner ingredients, or alternatively, by preblending reclaimed toner with fresh toner ingredients followed by extrusion are shown in Table 1. The results appear to demonstrate an unexpected result that melt mixing of reclaimed toner with fresh toner ingredients is, for example, important to achieving desired triboelectric properties, high admix ratings or fast admixing toners, and machine test results in the remanufactured toner. Machine test results include conventional metrics for development and image quality, such as toner mass per unit area, background scatter, line edge acuity, solid area deletions, and the like.

TABLE 1

Xerox Corporation Model 5090™ remanufactured toner results.

| Reclaim toner added at | % of reclaim toner added to fresh toner | Tribo (microC per gram) | Admix (seconds) | Machine test results |
|---|---|---|---|---|
| NA | Unscreened reclaim toner | 13 | NA | very high background |
| NA | Screened reclaim toner | 10 | >30 | very high background |
| melt mix step or an extruder feeder | 100% extruded reclaim toner | 10 | <15 | high background |
| preblend/melt mix or an extruder feeder | 25% reclaim toner | 18 | <15 | equivalent to new toner |
| preblend/melt mix or an extruder feeder | 20% reclaim toner | 19 | <15 | equivalent to new toner |
| preblend/melt mix or an extruder feeder | 10% reclaim toner | 18 | <15 | equivalent to new toner |
| preblend/melt mix or an extruder feeder | 5% reclaim toner | 19 | <15 | equivalent to new toner |

Comparative Example I

Example I was repeated with the exception that the screened toner was extruded without combining or mixing with fresh toner constituents, with the result that the remanufactured toner did not perform satisfactorily, reference Table 1, entry labeled "100% extruded reclaim toner".

EXAMPLE II

Example I was repeated with the exception that several hundred pounds of waste toner were obtained from the toner recovery compartments of the customer replaceable unit (CRU) toner dispensers from several dozen Xerox Corporation Model 265™ machines. It is readily apparent that the reclaimed toner can be combined with the fresh toner constituents or fresh toner particles at various stages of the toner manufacturing process prior to, or subsequent to melt mixing, with the result that the finished reclaimed toner has physical characteristics and imaging properties substantially identical with what is observed when only fresh or new toner constitutents are processed, reference Table 2. The fresh toner constitutents can be prepared in accordance with, for example, U.S. Pat. Nos. 5,227,460; 5,376,494, 5,406,357, and 5,229,242, the disclosures of which are incorporated herein by reference in there entirety. The reclaimed toner particles can be combined with the fresh toner at, for example: the pellet grinding stage such as a mixture of reclaimed toner particles and fresh toner constitutents as a mixture of extruder pellets; the external additive blending stage wherein fresh toner particles are combined with reclaimed toner particles and the mixture is subsequently treated with external surface additives; and at the screening stage wherein screened reclaim toner is combined with fresh toner constituents.

TABLE 2

| Xerox Corporation Model Document Center 265™ remanufactured toner. | | | |
|---|---|---|---|
| Reclaim toner addition stage | % of reclaim toner added | Tribo (microC/gram) | Admix |
| Control | Screened only | 15 | bimodal charge spectra-low charge toner[1] |
| melt mix step or extruder feeder | 100% | 19 | NA |
| preblend/melt mix or an extruder feeder | 28% | 22 | equivalent to new toner |
| preblend/melt mix or an extruder feeder | 20% | 22 | equivalent to new toner |
| preblend/melt mix or an extruder feeder | 12% | 19 | equivalent to new toner |
| preblend/melt mix or an extruder feeder | 6% | 18 | equivalent to new toner |
| extruded pellets - grinding step | 30% | 19 | equivalent to new toner |
| extruded pellets - grinding step | 20% | 19 | equivalent to new toner |
| extruded pellets - grinding step | 10% | 18 | equivalent to new toner |
| external additives blending step | 30% | 16 | NA |
| external additives blending step | 20% | 17 | NA |
| external additives blending step | 10% | 17 | NA |

[1]Low charge toner caused high background

EXAMPLE III

Magnetic Toner Preparation and Evaluation

Fresh magnetic toner comprising a polymer resin (74 weight percent of the fresh toner mixture) obtained by free radical polymerization of mixtures of styrene and butadiene monomers may be melt extruded with 10 weight percent of REGAL 330® carbon black and 16 weight percent of MAPICO BLACK® magnetite at 120° C., along with reclaimed and screened toner particles in an amounts of about 1 to about 25 weight percent of the total mixture, and the extrudate pulverized in a Waring blender and jetted and classified to 8 micron number average sized particles as measured by a Coulter counter with a classifier equipped with a classifier wheel to provide remanufactured magnetic toner particles. A positively charging magnetic toner may be prepared by surface treating the jetted toner (2 grams) with 0.12 gram of a 1:1 weight ratio of AEROSIL R972® (Degussa) and TP-302 a naphthalene sulfonate and quaternary ammonium salt (Nachem/Hodogaya SI) charge control agent. Alternatively, a combined fresh and reclaimed toner material can be prepared therefrom as described in Example I.

Developer compositions may then be prepared by admixing 3.34 parts by weight of the aforementioned remanufactured toner composition with 96.66 parts by weight of a carrier comprised of a steel core with a polymer mixture thereover containing 70 percent by weight of KYNAR®, a polyvinylidene fluoride, and 30 percent by weight of polymethyl methacrylate; the coating weight being about 0.9 percent. Cascade development may be used to develop a Xerox Model D photoreceptor using a "negative" target. The light exposure may be set between 5 and 10 seconds and a negative bias used to dark transfer the positive toned images from the photoreceptor to paper.

Fusing evaluations for the remanufactured toner and images obtained therefrom may be carried out with a Xerox Corporation 5028® soft silicone roll fuser, operated at 7.62 cm (3 inches) per second.

The actual fuser roll temperatures may be determined using an Omega pyrometer and checked with wax paper indicators. The degree to which a developed toner image adheres to paper after fusing is evaluated using a Scotch® tape test. The fix level is expected to be excellent and comparable to that fix obtained with toner compositions prepared from other methods for preparing toners. Typically greater than 95 percent of the toner image remains fixed to the copy sheet after removing a tape strip as determined by a densitometer. Alternatively, the fix level may be quantitated using the known crease test, reference the aforementioned U.S. Pat. No. 5,312,704, the disclosure of which is totally incorporated herein by reference.

Images may be developed in a xerographic imaging test fixture with a negatively charged layered imaging member comprised of a supporting substrate of aluminum, a photogenerating layer of trigonal selenium, 100 weight percent, and a charge transport layer of the aryl amine N,N'-diphenyl-N,N'-bis(3-methylphenyl)1,1'-biphenyl-4,4'-diamine, 45 weight percent, dispersed in 55 weight percent of the polycarbonate MAKROLON®, reference U.S. Pat. No. 4,265,990, the disclosure of which is totally incorporated herein by reference; images for toner compositions prepared from the remanufactured toner are expected to be of excellent quality with no background deposits and of high resolution over an extended number of imaging cycles exceeding, it is believed, about 75,000 imaging cycles.

Other remanufactured toner compositions may be readily prepared by conventional means from the pigmented thermoplastic resins particles obtained from the reclaimed toner particles and remanufactured toner processes of the present invention, including colored toners, single component toners, multi-component toners, toners containing special performance additives, and the like.

In embodiments, the processes of the present invention can be selected for and employed in preparing polymeric particulate materials including, but not limited to, crystalline, semicrystalline, and amorphous polymeric toner particles and developer coating materials, and mixtures thereof.

Other modifications of the present invention may occur to one of ordinary skill in the art based upon a review of the present application and these modifications, including equivalents thereof, are intended to be included within the scope of the present invention.

What is claimed is:

1. A process comprising:

collecting waste toner;

screening the collected waste toner melt mixing the screened waste toner with a second toner, and grinding and classifying the melt mixed toner product.

2. A process in accordance with claim 1, further comprising blending at least one surface additive with the melt mixed toner product.

3. A process in accordance with claim 1, wherein the melt mixing of screened waste toner to second toner is in a ratio of from about 1 to about 40 weight percent based on the total weight of the mixture.

4. A process in accordance with claim 1, wherein the melt mixing of screened waste toner to second toner is in a weight ratio of from about 2 to about 20 percent.

5. A process in accordance with claim 1, wherein the melt mixing of screened waste toner to second toner is in a weight ratio of from about 10 to about 20 percent.

6. A process in accordance with claim 1, wherein the waste toner is recovered from at least one printing machine.

7. A process in accordance with claim 6, wherein said at least one printing machine comprises from 1 to about 1,000,000 machines.

8. A process in accordance with claim 6, wherein the waste toner is collected from the waste toner sump in said at least one printing machine.

9. A process in accordance with claim 1, wherein the screening is accomplished with a screen with a mesh size diameter from about 30 to about 50 micron, wherein the screened waste toner has a volume average diameter particle size of less than about 30 to about 50 microns, and wherein the second toner has an volume average diameter particle size of about 8 to about 14 microns.

10. A process in accordance with claim 9, wherein the screening is accomplished with a turbo screener.

11. A process in accordance with claim 1, wherein there is removed from the waste toner by said screening extraneous debris of paper fibers, paper particulates, ambient dust, machine dirt, toner agglomerates and aggregates, carrier particle spall, paper clips, staples, hair fibers, textile fibers, and mixtures thereof, and wherein the average particle size of said debris is greater than about 30 to about 50 microns.

12. A process in accordance with claim 1, wherein the waste and second toner is melt mixed in an extruder at a temperature of from about 350° to about 450° F.

13. A process in accordance with claim 1, wherein the melt mixing is accomplished in an extruder or a rubber mill.

14. A process in accordance with claim 1, wherein the grinding and classifying are accomplished in a fluid bed jet mill.

15. A process in accordance with claim 1, wherein there results remanufactured toner particles with a triboelectric charge of from about 11 to about 21 microcoulombs per gram, and admix of about 5 to about 15 seconds, a glass transition temperature of about 55° C., and a melt index of about 23 to about 31 gram per 10 minutes.

16. A process in accordance with claim 1, wherein the screened toner is reclaimed in amounts of from about 80 to about 99.99 percent based on the weight of the waste toner collected, and wherein the screening removes extraneous debris from the reclaimed toner in amounts of about 0.01 to about 20 weight percent of the waste toner collected.

17. A process in accordance with claim 1, wherein the second toner comprises toner constituents selected from the group consisting of a resin or resins, a colorant or colorants, a charge additive, a flow additive, recovered or recycled toner fines, and physical and melt mixtures thereof.

18. A process comprising:

collecting waste toner from at least one xerographic printing machine;

screening the collected waste toner to remove extraneous debris and to afford screened waste toner;

extruding in an extruder apparatus, in a weight ratio of about 10 to about 20 weight percent, the screened waste toner in admixture with a second toner comprising a resin, and a colorant, to provide a melt mixed product; and grinding and classifying the melt mixed product to provide remanufactured toner particles with a glass transition temperature of about 53° to about 58° F.

19. A process comprising:

collecting waste toner from at least one printing machine;

screening the collected waste toner to remove extraneous debris to afford screened waste toner; and combining the screened waste toner with fresh toner constituents comprising a resin, and a colorant, and wherein said combining is accomplished at a stage in toner manufacturing processing selected from the group consisting of pellet grinding, external additive blending, and screening, to provide remanufactured toner particles.

20. A printing machine comprising a development system comprised of a developer comprised of the melt mixed toner product obtained from the process of claim 1.

* * * * *